United States Patent [19]

Nestegard

[11] Patent Number: 4,741,527

[45] Date of Patent: May 3, 1988

[54] EXERCISE ARM FOR A STATIONARY BICYCLE

[76] Inventor: Sander C. Nestegard, 175 Galtier Pl., Shoreview, Minn. 55126

[21] Appl. No.: 916,006

[22] Filed: Oct. 3, 1986

[51] Int. Cl.[4] ..... A63B 23/02

[52] U.S. Cl. ..... 272/73; 272/117

[58] Field of Search ..... 272/71, 93, 73, 72, 272/136, 117, 70, 97; 135/66; 128/25 R

[56] References Cited

U.S. PATENT DOCUMENTS

| | | | |
|---|---|---|---|
| 3,455,295 | 7/1969 | Kellogg | 272/73 |
| 3,721,438 | 3/1973 | Kusmer | 272/72 |
| 4,451,033 | 5/1984 | Nestegard | 272/117 |

FOREIGN PATENT DOCUMENTS

| | | | |
|---|---|---|---|
| 2759041 | 7/1979 | Fed. Rep. of Germany | 272/97 |
| 2814756 | 10/1979 | Fed. Rep. of Germany | 272/73 |
| 2098494 | 11/1982 | United Kingdom | 272/73 |

*Primary Examiner*—Richard J. Apley
*Assistant Examiner*—S. R. Crow
*Attorney, Agent, or Firm*—John C. Barnes

[57] ABSTRACT

Weighted bars may be pivotally connected at one end outward of the pedals on a stationary bicycle exerciser and provided with hand grips at the opposite end to permit the exercise of the upper body as well as exercise of the lower body on the bicycle, the pivotal connection provides fore-and-aft and sideways movement of the bars.

4 Claims, 1 Drawing Sheet

EXERCISE ARM FOR A STATIONARY BICYCLE

DESCRIPTION

1. Field of the Invention

This invention relates to an improvement in stationary exercise devices, and more particularly, to an arm for exercising the upper body while using a stationary bicycle type exerciser.

2. Background Art

This invention is directed to an improvement to the invention described and claimed in U.S. Pat. No. 4,451,033, wherein an arm is attached to the pedal shaft of an exercise bicycle of the stationary type. The arm is movable about the axis of the pedal shaft to afford increased exercise for the body during pedaling. The added exercise was afforded by the movement of the two ends of the arms distal from the pedals toward and away from shoulders of the person operating the bicycle exerciser to move the upper limbs. The amount of exercise was enhanced by means of an adjustable weight which was fitted on the arm to move toward and away from the pedal to decrease or increase the force necessary to move the distal end of the arm about the axis of the pedal shaft and toward and away from the shoulder of the operator.

The exercise was somewhat limiting, however, to movement of the person's hands in a circular path while moving the hands toward and away from the shoulders.

The present invention improves on the prior art in that distal ends of the weighted arms can also swing outwardly away from the sides of the bicycle and in an axial direction to the axis of the pedal shaft while the pedal shaft is rotating within the sleeve.

The present invention is directed to an improved arm which will improve the amount of flexibility of the arms and shoulders and increase the number of muscles exercised while on a stationary bicycle exerciser.

SUMMARY OF THE INVENTION

The present invention relates to an arm or arms for a stationary bicycle exercising machine, i.e., an exercise bicycle. The arm comprises a sleeve which will receive the pedal shaft of a bicycle pedal, to be positioned adjacent the outer end of the pedal away from the sprocket crank arm. A universal connection is made between the pedal shaft and a rod extending from said sleeve to a distal end supporting a hand grip. The connection between the rod and the sleeve allows freedom of movement of the distal end of the rod in a plane radial to the pedal shaft axis and, in other words, axially of the rod in an arc about the connecting means. The rotational movement between the sleeve and the pedal shaft affords rotational movement of the arm about the axis of the pedal shaft.

The connecting means comprise a bracket extending radial to the exterior surface of a cylindrical tube which bracket has a hole therethrough and a pair of members forming a bifurcated end on said rod. The bifurcations are spaced to receive the bracket therebetween and a pin fits through aligned holes in the bifurcations and the hole in the bracket to form a pivot axis perpendicular to the axis of the cylindrical tube.

The rods are preferable provided with adjustable weights which can be moved along the length of the rods. The weights are metal rods disposed in the inner hollow bores of the rods, affording a more aesthetic appearance, but adjustable weight to vary the exercise.

BRIEF DESCRIPTION OF THE DRAWING

The present invention will be more fully described with reference to the accompanying drawing, wherein.

The present invention is directed to an improvement for stationary exercise bicycles. The improvement is the adding of arms on the extended ends of the pedal shafts to permit exercising of the upper body while pedalling.

The arms of the present invention permit the distal or free ends of the arms to be moved in an arc axially of the pedal shaft axis during pedalling as well as in a circular motion and toward and away from the shoulder of the operator.

Figure 1:
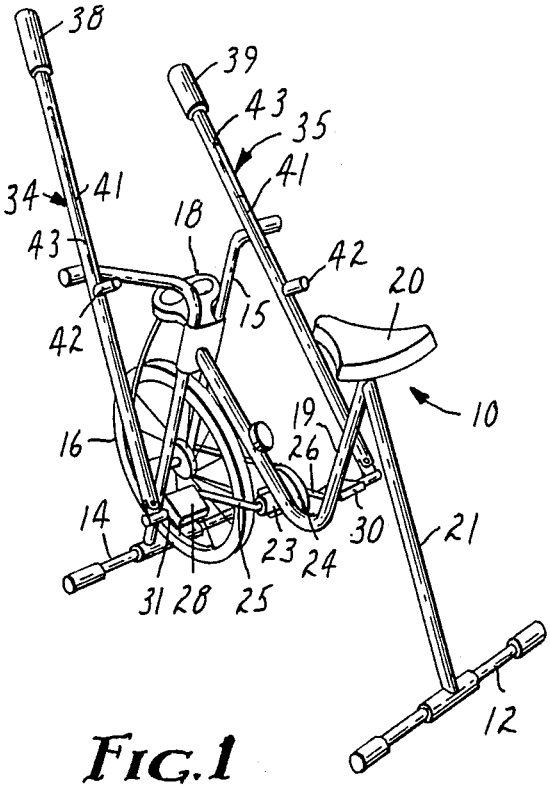
FIG. 1 is a perspective view of an exercise bicycle incorporating arms formed according to the present invention.

As illustrated in FIG. 1, a stationary exercise bicycle, generally designated 10, comprises a frame including two parallel spaced feet 12 and 14. A fork 15 extends upwardly from the foot 14. The fork 15 rotatably supports the driven wheel 16. A panel 18 supports the instruments to determine the speed of the wheel 16 or the amount of resistance afforded by the brake means (not shown) for the driven wheel. A V-shaped brace member 19 extends from the fork 15 to a brace member 21 to support a sprocket wheel 24 and a seat 20. The brace member 21 is connected to the rear support foot 12.

The brace member 19 supports a bearing hub 23 for supporting or journalling the axis of the sprocket wheel 24 from which extends two radial crank arms 25 and 26.

On the stationary bicycle, it is preferred that a vertical line through the center of the seat 20 be positioned between 12 and 15 inches rearward of a vertical line through the center of the sprocket wheel 24. To the free ends of the crank arms 25 and 26 are horizontally extending pedal shafts which are generally fixed thereto and which support pedals 28 and 30. These shafts, identified by the reference numeral 31, extend through the pedals 28 and 30 and provide suitable journals for the pedals such that the pedals are free to rotate on the shafts. The extended ends of the shafts 31 are then pivotally connected respectively, to one end of a pair of weighted arms 34 and 35. The shafts have an extended length beyond the edge of the pedals such that the ends of the arms will be spaced outward from the sprocket a sufficient distance past the pedal to avoid interference with the operator's leg.

The weighted arms 34 and 35, as mentioned, are provided with means to universally mount said arms on the shafts 31 at one end and are provided with grips or hand grips 38 and 39 at the opposite distal ends which may be grasped by the operator during the exercise program. The weighted arms are movable to and fro about their pivotal connection to the shafts 31, and the distal ends can move generally axially in an arc to swing outwardly from the sides of the bicycle 10.

The rotational movement of the lower end of the arms 34 and 35 causes the hand grips 38 and 39 to move up and down as they are driven by the sprocket. This causes a similar upward and downward movement of the operator's hands and arms and rotation of the upper arm at the shoulder to increase the flexibility of the shoulder. The movement of the hand grips 38 and 39 by the hands toward and away from the shoulder against the forces necessary to cause the arms 34 and 35 to accelerate and decelerate with the desired moment arm afforded by the position of and weight on each arm 34 and 35 strengthens the arm.

The connecting means between the end of the arm and the pedal shaft 31 also permits the distal end of the arms 34 and 35 to swing away from the bicycle frame to permit the arms to swing away from the body and further rotate the arm of the operator about the shoulder joint.

Figure 2:
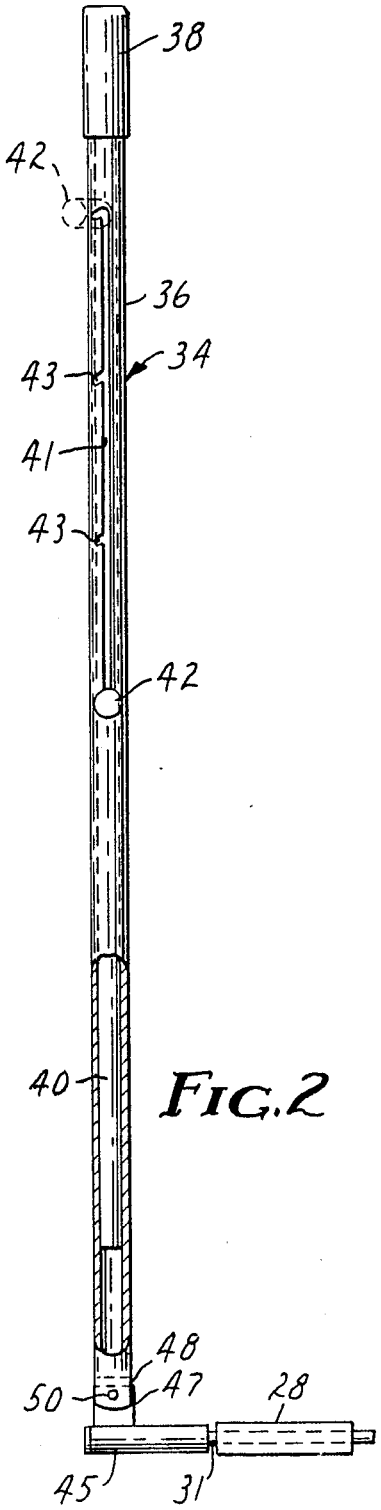
FIG. 2 is a plan view of an arm of the present inventory having portions thereof broken away to illustrate interior members.

Each arm 34 and 35 is similarly constructed but preferably one for the right hand and one for the left hand. An arm preferably comprises a rod between forty and forty-six inches long, formed of a straight elongate hollow tube 36 of aluminum having an outside diameter of one inch and a wall thickness of about 0.055 inch. Disposed within the hollow tube is a solid rod 40 of steel which weighs approximately 5 pounds and has an outside diameter of $\frac{7}{8}$ inch, and which is 24 inches long. The rod 40 is disposed within the hollow tube 36 in such a manner that it is movable within the tube from a position with one end adjacent the connecting means for the arm to the pedal shaft and a position where one end is adjacent the distal end of the arm near the hand grip. The tube is provided with an elongate slot 41 in one side through which extends a handle 42 fixed to the rod 40. The handle 42 may be moved up and down within the slot 41 to change the position of the weight within the tube. As illustrated in FIG. 2, the slot 41 is provided with transversely and angularly disposed communicating slots 43 which define the positions in which the weight may be fixed to change the moment arm of the weight about the pedal shaft. This change in the position of the weight changes the amount of force necessary to swing the arm about its pivoted end and changes the amount of exercise afforded the operator.

Figure 3:
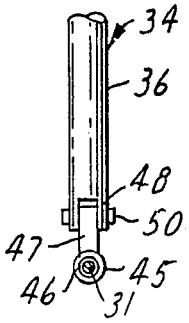
FIG. 3 is a fragmentary side view of the arm of FIG. 2.

Referring now to FIGS. 2 and 3, each arm is provided at its lower end with a hollow cylindrical sleeve 45, of metal preferably having a nylon or other bearing material insert 46, through which, coaxially therewith, fits the pedal shaft 31. Connecting the tube 36 to the sleeve 45 is connecting means comprising an eye bracket 47 which is secured to the sleeve 45 and extends radially of the axis of the sleeve 45. The bracket 46 is a rectangular piece of sheet stock with a hole extending between the sides thereof. The tube 36 has a bifurcated end defined by two parallel spaced plates 48 and 49 each having a hole, aligned with the hole in the other plate to receive a pin 50 which extends through the bifurcations 48 and 49 and the hole in the eye bracket 46. The plates 48 and 49 are connected to the end of tube 36 by weldments or other bonding. Such a connecting means defines a universal connection between the tube 36 and the pedal shaft.

Having thus disclosed the present invention with respect to a preferred embodiment, it will be appreciated that further modifications may be made without departing from the scope or spirit of the invention as defined by the appended claims.

I claim:

1. An arm for a stationary exercise bicycle to increase the exercise gained while pedalling comprises, hollow cylindrical sleeve means having an axis for rotatably receiving coaxially the pedal shaft of a bicycle sprocket, a rod having a first end and a distal end, a hand grip attached to said distal end, connecting means connecting said first end of said rod to said sleeve means for affording swinging movement of said distal end axially of said sleeve means, wherein said connecting means comprises an eye bracket extending radially from said sleeve means and having a hole perpendicular to the axis of said sleeve means, said first end of said rod having a bifurcated end to receive said eye bracket, and a pin through said bifurcation and said hole for defining a pivotal connection to said sleeve means perpendicular to the axis of said sleeve means.

2. An arm according to claim 1 wherein said rod includes adjustable weight means for changing the force required to swing said arm about the axis of said sleeve means.

3. An arm according to claim 1 wherein said rod comprises a hollow cylindrical tube and a cylindrical weighted rod disposed within said hollow tube, said tube and weighted rod having means for adjusting the position of the rod in said tube.

4. An arm according to claim 1 wherein said rod comprises a hollow cylindrical tube and a cylindrical weighted rod disposed within said hollow tube, said tube and weighted rod having means for adjusting the position of the rod in said tube.

* * * * *